US006083286A

United States Patent [19]

Ono

[11] Patent Number: 6,083,286

[45] Date of Patent: Jul. 4, 2000

[54] HIGH-CONCENTRATION COAL/WATER MIXTURE FUEL AND PROCESS FOR PRODUCTION THEREOF

[75] Inventor: Tetsuo Ono, Yokosuka, Japan

[73] Assignee: Central Research Institute of Electric Power Industry, Tokyo, Japan

[21] Appl. No.: 09/043,251

[22] PCT Filed: Sep. 6, 1996

[86] PCT No.: PCT/JP96/02546

§ 371 Date: Mar. 5, 1998

§ 102(e) Date: Mar. 5, 1998

[87] PCT Pub. No.: WO97/09399

PCT Pub. Date: Mar. 13, 1997

[30] Foreign Application Priority Data

Sep. 8, 1995 [JP] Japan ..... 7-255806
Mar. 11, 1996 [JP] Japan ..... 8-53377

[51] Int. Cl.[7] ..... C10L 1/32

[52] U.S. Cl. ..... 44/280; 44/620; 44/629

[58] Field of Search ..... 44/620, 280, 629

[56] References Cited

U.S. PATENT DOCUMENTS

| | | | |
|---|---|---|---|
| 4,142,868 | 3/1979 | Gencsoy | 48/86 R |
| 4,154,871 | 5/1979 | White et al. | 427/27 |
| 4,242,098 | 12/1980 | Braun et al. | 44/280 |
| 4,415,338 | 11/1983 | Schick et al. | 44/280 |
| 4,436,528 | 3/1984 | Schick et al. | 44/280 |
| 4,526,584 | 7/1985 | Funk | 44/280 |
| 4,712,742 | 12/1987 | Ogawa et al. | 44/280 |
| 4,722,740 | 2/1988 | Donnelly | 44/280 |
| 4,787,915 | 11/1988 | Meyer et al. | 44/620 |
| 4,872,885 | 10/1989 | Tsubakimoto et al. | 44/280 |
| 5,123,931 | 6/1992 | Good et al. | 44/280 |

FOREIGN PATENT DOCUMENTS

| | | |
|---|---|---|
| 113517 | of 1983 | Japan . |
| 225955 | of 1983 | Japan . |
| 248035 | of 1984 | Japan . |
| 59-30894 | of 1984 | Japan . |
| 59-43093 | of 1984 | Japan . |
| 596288 | of 1987 | Japan . |
| 63-20276 | of 1988 | Japan . |
| 6264075 | of 1994 | Japan . |
| 63113098 | of 1998 | Japan . |

OTHER PUBLICATIONS

PCT/JP96/02546 Search Report Dec. 10, 1996.

*Primary Examiner*—Margaret Medley
*Attorney, Agent, or Firm*—Notaro & Michalos P.C.

[57] ABSTRACT

The present invention relates to high-density coal-water mixed fuel and a producing method thereof and aims to reduce an amount of dispersant to be used in the coal-water mixed fuel having the good fluidity with the increased density and obtain the a coal-water mixed fuel from pulverized coals produced by dry milling at low cost. According to this invention, in case of obtaining the high-density coal-water mixed fuel such as a CWM by mixing the pulverized coals ground to provide a predetermined particle size distribution, water and the dispersant, the hydrophilic colloid which causes the protective effect with respect to the pulverized coals is added and mixed preferably before adding the dispersant so that the high-density coal-water mixed fuel which includes the hydrophilic colloid and a reduced amount of a surface active agent used can be provided. An amount of the hydrophilic colloid to be added is less than 1 wt % of the entire CWM and larger than an amount for causing reciprocal aggregation with the pulverized coals, or more preferably it is in the order from ppm to ppt. Further, when the pulverized coals are rubbed together and the angles thereof are shaved off for production from the pulverized coals, the pulverized coals are spheroidized without extremely being minimized from their original particle size, and superfine particles in the coal particles are generated, thereby enabling adjustment to provide a preferable particle size distribution as the CWM.

7 Claims, 10 Drawing Sheets magnification
100 magnification
100

HIGH-CONCENTRATION COAL/WATER MIXTURE FUEL AND PROCESS FOR PRODUCTION THEREOF

This application is a 371 of PCT/JP96/025446 filed on Sep. 6, 1996.

FIELD OF THE INVENTION

The present invention relates to coal-water mixed fuel obtained by mixing coals and water and the producing method thereof. More particularly, the present invention relates to high-density coal-water mixed fuel which can maintain the good fluidity with a high density and the producing method thereof.

BACKGROUND OF THE INVENTION

One method for utilizing coals has been recently proposed. That is, the coals are pulverized and mixed with a small amount of water for slurrying with a high density and pasting in order to enable the transportation using a pipeline or the like. The product obtained by such a method is referred to as the high-density coal-water mixture or slurry (this will be abbreviated as CWM hereinafter) or the high-density coal-water paste (this will be also abbreviated as CWP hereinafter).

In case of the CWM, the density of the coal is increased to 65 through 70 wt % by adjusting the coal particle size distribution to provide the fluidity, and the coal is directly burned in an ordinary boiler without dehydration. Meanwhile, in case of the CWP, the coal particle size distribution is adjusted so that the particle size can be equal to or less than 6 mm which is slightly larger than that in the CWM, and water is added to the coals together with the desulfurizing agent to provide the density of 70 through 80 wt % to give the fluidity. The CWP is then pushed out from the pipeline into a fluidized bed combustion boiler by a pump and burned without making any change. In order to carry out these processes, the water density is decreased as low as 30 through 35 wt % and the sufficient fluidity is required in the CWM or CWP.

Although the method for producing the CWM or CWP has been already commercialized in the wet manufacturing method utilizing the wet grinding, the stronger grinding power is required when carrying out the wet grinding, which increases the manufacturing cost. Development of the dry manufacturing method utilizing the dry grinding with the reduced grinding power is thus desired. In the dry manufacturing method, drying the pulverized coals during pulverization provides the strong water repellency and makes the slurrying difficult. Therefore, in the conventional CWM or CWP production, in order to facilitate flow using the pipeline by slurrying the pulverized coals having the strong water repellency, it is required to add 0.1 through 1 wt % of the dispersant having the general surface active agent as a main component which may be substituted any other material depending on properties of the surface active agent when producing the CWM having a high density of, e.g., 65 through 70%. This improves the wettability of the pulverized coals and prevent aggregation of the pulverized coals in water. Of course, it is similarly necessary to add a large amount of the surface active agent in the wet producing method in order to improve the wettability of the pulverized coals and prevent aggregation of the pulverized coals.

However, in the CWM or CWP described above, the cost of the dispersant per unit is relatively high, and hence the cost of the dispersant accounts for about 20 to 40% of the cost of the CWM or CWP, even the amount of the dispersant accounts for 0.1 through 1 wt % of the amount of the CWM or CWP.

Various kinds of dispersant have been proposed for reducing the cost of the dispersant. For example, although the dispersant which has a high efficiency and whose amount can be reduced has been developed, this type of dispersant disadvantageously increases the cost per unit. Further, the inexpensive dispersant has been also developed, but an amount of this dispersant to be added must be increased. Thus, reduction in the cost of the dispersant is difficult, and hence the cost of the CWM or CWP can not be lowered.

In addition, the fluidity of the CWM or CWP depends on how the particles fill. The middle-sized particles enter into a gap between the large particles, and the small particles enter into a gap between the middle-sized particles. Further, the superfine particles enter a gap between the small particles, and water enters a gap between the superfine particles. This small amount of water generates the fluidity, and the superfine particles which exist around the relatively large particles having the size not less than a few $\mu$m and have the size of approximately 1 $\mu$m serve as the lubricant, thus assuring the fluidity.

However, in the conventional CWM or CWP producing method in the dry manufacturing method, the pulverized coal obtained by the dry pulverization has an unspecified substantially-polyhedral angular shape, and a large gap is then made between the particles. The gap is not filled even though the regularly-generated amount of superfine particles is introduced, thereby making realization of the high density of the CWM difficult. Furthermore, even if realization of the high density of the CWM is possible, the lack of the superfine particles causes the relatively-large coal particles (a few $\mu$m or more) to come into contact with each other without the superfine particles, thereby making the enhancement of the fluidity difficult.

In order to realize the high density and enhance the fluidity of the CWM or CWP, there is considered a method such as that a large amount of coal particles having the size of approximately 1 $\mu$m which are referred to as superfine particles is prepared and mixed and such particles are provided between the large coal particles.

However, in the above-described CWM or CWP producing method, since a great amount of superfine particles which are relatively difficult to be pulverized is required, and the mass production is hard to be effected, which actually leads to difficulty in reduction in the manufacturing cost. It is to be noted that the CWM and CWP are generally referred to as the high-density coal-water mixed fuel in this specification and the high-density coal-water mixed fuel includes the high-density coal-water paste as well as the high-density coal-water slurry unless it is specified.

DISCLOSURE OF THE INVENTION

It is an object of the present invention to provide the high-density coal-water mixed fuel which can maintain the fluidity even if the density is increased. More particularly, an object of the present invention is to provide the high-density coal-water mixed fuel and the producing method thereof with which the cost for the dispersant can be reduced. It is another object of the present invention to provide the inexpensive high-density coal-water mixed fuel producing method which can mass-produce the CWM or CWP by the dry grinding without mixing a large amount of superfine particles.

Various kinds of study for achieving these aims caused the present inventors to perceive that the high-density coal-water mixed fuel has the coal particles dispersed in the water and contains a large amount of particles having the size of 1 μm or less and the fuel hence corresponds to the colloid dispersed system or ranges from the coarse particle dispersed system to the colloid dispersed system. Therefore, it is enough to prevent the dispersed particles from being connected with each other in order to maintain the colloid stable and, as one of methods for attaining such prevention, the inventors considered to utilize the so-called the protective effect of the colloid. That is, the affinity between the dispersion medium and the dispersoid is utilized and the hydrophilic colloid is adsorbed to the surface of the coal particles which are the hydrophobic colloidal particles to demonstrate the characteristic as if the coal particles are the hydrophilic colloid, thereby increasing the stability. The pulverized coal slurry generated by mixing the pulverized coal, the water and the hydrophilic colloid, however, has the increased viscosity and the deteriorated fluidity. It was discovered that mixing the dispersant whose amount is smaller than that usually added to the slurry can reduce the viscosity to provide the excellent fluidity. This phenomenon is considered to be caused for the following reasons.

(1) Gelation and solation by the protective colloid

The hydrophilic colloid is adsorbed to the surface of the pulverized coal particles which are the hydrophobic colloid particles and the surface of the pulverized coal particles is covered with the hydrophilic colloid to achieve hydrophilicity. This causes the hydrophilic colloid to show the protective action with respect to the pulverized coals as the protective colloid. The pulverized coal particles which have adsorbed the protective colloid are subjected to the secondary bond by the ionic bond or the like through the multiply charged ion such as metallic ion solved out from the pulverized coal particles and the reversible pulverized coal gel is generated. It can be assumed that such process increases the viscosity of the slurry and degrades the fluidity of the same.

The secondary bond achieved between the pulverized coal particles is destroyed by mixing the dispersant into the slurry and the pulverized coal gel is returned to the sol. The pulverized coal particle keeps its hydrophilicity and becomes stable by the protective action of the protective colloid without aggregation. As a result, it can be assumed that the high-density coal-water mixed fuel having the sufficient fluidity can be provided.

In this case, an amount of the dispersant to be added is enough if it can destroy the secondary bond between the pulverized coal particles, and hence the amount of the dispersant to be added can be reduced as compared with the case when only using the dispersant which is used for preventing aggregation of the pulverized coal particle without adding the hydrophilic colloid.

(2) Aggregation of the fine particles caused by the electrolyte and dispersion caused owing to antagonism of the ion Since the pulverized coals are fine particles and have electric charges, the ion having the reverse sign (counter ion) is attracted therearound, which constitutes the double structure called the electrical double layer. The pulverized coal particles are usually dispersed colloidally by the electrical repulsion of the counter ions. However, if the electrolyte is given by addition of the hydrophilic colloid, the counter ions are pushed against the surface of the particles, thereby reducing the thickness of the fine electrical double layer. It can be considered that decrease in the distance between the particles causes the respective pulverized coal particles to enter the range of attraction between the particles and to aggregate.

Mixing the dispersant into the slurry adds the electrolyte that is different from the above-described electrolyte. Two or more kinds of electrolyte are added to the pulverized coal particle and the aggregating force of the pulverized coal particle is suppressed by the antagonism of the ion. It is considered that this process can provide the high-density coal-water mixed fuel having the sufficient fluidity.

In this case, since an amount of the dispersant to be added is enough if it can provoke the antagonism of the ion with respect to the pulverized coal particles, the amount of the dispersant to be added can be reduced as compared with the case where only the dispersant is used to prevent aggregation of the pulverized coal particles without adding the hydrophilic colloid.

(3) Aggregation of the fine particles caused due to the high polymer material and dispersion of the pulverized coals caused by the bimolecular layer adsorption of the dispersant Since the hydrophilic colloid is a water soluble high polymer substance and has many hydrogen bonding groups, the hydrophilic colloid is adsorbed to the pulverized coal particles by the hydrogen bonding groups irrespective of the electricity or the ion. If a small amount of the high polymer is adsorbed to the pulverized coal particles, it is not evenly adsorbed but sparsely adsorbed to the surface of the particle. A part of the high polymer adsorbed to the particle is, therefore, adsorbed to the unoccupied area on the surface of a different particle, and one high polymer is hence bonded to two or more particles. It can be assumed that the pulverized coal particles are aggregated by such action. This is a phenomenon called "the cross linking aggregation".

Mixing the dispersant into the slurry causes the ion of the dispersant to be subjected to the bimolecular layer adsorption to the unoccupied area on the surface of the particle. The entire pulverized coal particles thus have the electric charges and are dispersed. As a result, it is assumed that the high-density coal-water mixed fuel having the sufficient fluidity can be obtained.

By mixing the dispersant into the pulverized coal particles which have been subjected to the cross linking aggregation, the high polymer bonded to one pulverized coal particle is also bonded to the unoccupied area on the surface of the same particle. Multiple high polymers are entangled around the respective particles and become the high polymer like a knitting ball to cover the entire surface of the pulverized coal particle. The high polymers for bonding the particles are reduced and the respective particles repulse. It is considered that such a phenomenon can provide the high-density coal-water mixed fuel having the sufficient fluidity.

In this case, an amount of the dispersant to be added is enough if the dispersant itself or the knitting-ball-like high polymer can cover the unoccupied area of the pulverized coal particle, and hence the amount of the dispersant to be added can be reduced as compared with the case where only the dispersant is used to prevent the pulverized coal particle from aggregating without adding the hydrophilic colloid.

Incidentally, it can be considered that not only one of the above-described phenomena but also the respective phenomena can be simultaneously occur while they are associated with each other. Also, it can be assumed that the fluidity can be similarly obtained even though an amount of the dispersant to be added is greatly reduced for any reason other than the above-described reasons.

On the basis of the above-mentioned knowledge, the high-density coal-water mixed fuel obtained by mixing the pulverized coal, the water and the dispersant includes the hydrophilic colloid that causes the protective effect with respect to the pulverized coals according to the present invention. The hydrophilic colloid causing the protective effect to the pulverized coals is added and mixed in the high-density coal-water mixed fuel when manufacturing the high-density coal-water mixed fuel by mixing the water, the dispersant and the pulverized coals obtained by grinding the coal so as to provide a predetermined particle size distribution.

Therefore, an amount of the dispersant to be added is enough if it can destroy the secondary bond of the pulverized coal particles, if it can cause the antagonism of the ion with respect to the pulverized coal particles, or if it can cover the unoccupied area on the surface of the pulverized coal particle by the dispersant itself or the knitting-ball-like high polymer, and hence the amount of the dispersant to be added can be greatly reduced as compared with the case where only the dispersant is used to prevent aggregation of the pulverized coal particles as in the prior art. For example, when producing the CWM whose density is 70%, the fluidity of the CWM was not lost even though an amount of the surface active agent was reduced to approximately ⅓ of the usual amount as apparent from the measured data shown in FIG. 14. In addition, as apparent from the measured data FIG. 14, it was possible to produce the CWM having the relationship between the density and the viscosity of the coal substantially unchanged even though the amount of the dispersant to be added is reduced to ½ of the usual amount by adding the hydrophilic colloid.

The cost of the high-density coal-water mixed fuel can be, therefore, reduced by lowering the cost of the dispersant by decreasing the amount of the dispersant to be added while maintaining the fluidity of the CWM unchanged.

The existing manufacturing equipment for the high-density coal-water mixed fuel can be utilized as it is because the hydrophilic colloid is only added, thus substantially requiring no increase of the equipment.

Here, the amount of the hydrophilic colloid to be added slightly reduced the amount of the surface active agent to be added if the hydrophilic colloid demonstrating the protective effect to the pulverized coals and the surface active agent were simultaneously added, but the effect was not enough as the above-mentioned effect. Further, addition of the surface active agent followed by that of the protective colloid did not lead to reduction in the amount of the surface active agent used. In production of the high-density coal-water mixed fuel, it is preferable to add the hydrophilic colloid in a mixture of the pulverized coals and the water and thereafter add the dispersant. In such a case, the gel type pulverized coal slurry is generated by adding and mixing the hydrophilic colloid in the mixture of the pulverized coals and the water. The gel type pulverized coal slurry becomes the sol by adding and mixing the dispersant in this slurry. The reason why this phenomenon occurs is described above. This process enables production of the high-density coal-water mixed fuel in which the amount of the dispersant is largely reduced. For example, as apparent from the measured data shown in FIG. 14, the amount of the dispersant can be reduced to ½ to ¼ of the conventional amount of the same by adding 1 ppm of the hydrophilic colloid prior to the dispersant in order to obtain the high-density coal-water mixed fuel having the fluidity equivalent to that of the conventional high-density coal-water mixed fuel having the dispersant of, e.g., 0.4 wt % without adding the hydrophilic colloid.

Moreover, the amount of the hydrophilic colloid may be enough and small when the hydrophilic colloid is adsorbed to the coal fine particle which is the hydrophobic colloid particle and demonstrates the protective effect for making the surface of the coal fine particle hydrophilic, or preferably it may be smaller than 1 wt % of the entire high-density coal-water mixed fuel and larger than that which can provoke the reciprocal aggregation with the pulverized coal, or more preferably it may be ranged between the ppm order to the $10^{-3}$ ppt order of the entire fuel, or most preferably it may be ranged between the ppt order to the ppb order of the same. Since increase in the amount of the hydrophilic colloid to be added causes bonding between the pulverized coals to be stronger by the high gelatination, the amount of the dispersant to be added must be increased in order to destroy this bonding, thereby deteriorating the reduction effect of the dispersant. On the contrary, if the amount of the hydrophilic colloid to be added is too small, such an amount causes the sensitizing effect resulting in the unstable hydrophobic colloid. Specifically, as apparent from the measured data shown in FIG. 13, when the amount of the colloid to be added to the water exceeds 10 ppm in order to obtain the CWM having the density of 70%, the fluidity is degraded. If the amount of the hydrophilic colloid to be added is smaller than $10^{-4}$ ppt, the fluidity is also deteriorated.

In addition, the method for producing the high-density coal-water mixed fuel according to the present invention, the coal is powdered by using a mill to obtain the pulverized coal having the size substantially smaller than a predetermined value, angles of the pulverized coals are removed to provide a spherical shape and to generate the superfine particles by abrading these coals together by using a spheroidizing apparatus for pushing and rubbing the pulverized coals, thereby the high-density coal-water mixed fuel is produced.

The pulverized coals obtained by grinding the coal by a mill correspond to the fine particles most of which have a particle size lower than a predetermined value, or more particularly, a particle size equal to or less than 100 $\mu$m, and this particle is an undefined angular polyhedron which is relatively large for the high-density coal-water mixed fuel, as shown in FIGS. 5(A) and 6. Further, in regard of the particle size distribution (mass basis), the particle size equal to or less than 100 $\mu$m accounts for approximately 93%; the particle size equal to or less than 10 $\mu$m, approximately 15%; and the particle size equal to or less than 1 $\mu$m, less than 1%, as shown by circles in FIG. 12. The fine particle component having the particle size equal to or less than 10 $\mu$m is lacking for obtaining the CWM.

However, the pulverized coals are pushed and rubbed in the spheroidizing apparatus, and these coals are ground when they are rubbed together. As shown in FIGS. 5(B) and 7, the pulverized coal loses its angles and is spheroidized to reduce the surface area thereof. Also, the removed angle becomes a superfine particle having the size equal to or less than 1 $\mu$m. Therefore, as to the particle size distribution (mass basis), the particle size equal to or less than 100 $\mu$m accounts for approximately 100%; the particle size equal to or less than 10 $\mu$m, approximately 45%; and the particle size equal to or less than 1 $\mu$m, approximately 17%, as shown by black circles in FIG. 12. These satisfy the values required as the CWM. It is possible to obtain the CWM in which a gap between the respective spheroidized pulverized coal particles is filled with the superfine particles. Further, spheroidization of the pulverized coal according to the present invention can be applied to manufacture of the COM (coal-oil mixture).

In other words, when the pulverized coal loses its angles and is spheroidized to reduce the surface area, an amount of the superfine particles required for filling a gap between the respective pulverized coals is decreased. Apart that is apt to be scraped off is removed and the body particle is spheroidized, but the original particle size can not be extremely reduced, thus generating the superfine particle. On the other hand, the angle scraped off becomes a superfine particle and fills a gap between the respective spheroidized pulverized coals. A sufficient amount of the superfine particles, therefore, fills the gap between the pulverized coals. This enables adjustment to realize the wide particle size distribution required for the high-density coal-water mixed fuel to obtain the fluidity, i.e., the particle size distribution which enables easy generation of relatively-large spheroidized particles to superfine spheroidized particles by removing angles to spheroidize the pulverized coal and is suitable for the high-density coal-water mixed fuel. Water is removed from the gap between the pulverized coal particles to obtain the CWM or CWP having a high density. Since the superfine particles attached to the surface of the pulverized coal in the covering manner to cause the lubricating effect, the CWM or CWP having the high fluidity can be obtained.

It is apparent from the measured data shown in FIG. 15 that the fluidity of the spheroidized CWM (shown by black triangles) is higher than that of the non-spheroidized CWM (shown by white triangles). Further, production of the CWM or CWP can be facilitated to reduce the manufacturing cost because a large amount of the superfine particles does not have to be mixed. Also, according to the present invention, since pulverizing power is further minimized, the existing manufacturing equipment can be utilized without making any change, and an increase of the equipment is substantially unnecessary.

Moreover, according to the high-density coal-water mixed fuel producing method, first and second members having a small gap between the opposed surfaces thereof are provided in a spheroidizing apparatus; the first and second members are capable of relative motion with the gap between their opposed surfaces being substantially fixed; and the pulverized coals held between the opposed surfaces are pushed and rubbed to be abraded together and the pulverized coal is spheroidized by removing its angles to produce superfine particles. In this case, the wet pulverized coals are pushed and rubbed to be abraded together by the opposed surfaces of the first and second members performing the relative motion so that angles of the pulverized coal are removed to facilitate easy spheroidization. In addition, the removed angles become superfine particles and are separated from the pulverized coal. The spheroidizing apparatus can be inexpensively obtained to reduce the producing cost for the CWM or CWP.

BRIEF DESCRIPTION OF THE DRAWINGS

FIG. 5 is typical views showing the state where the pulverized coal is spheroidized, in which FIG. 5(A) shows the state before spheroidization and FIG. 5(B) shows the state after spheroidization;

BEST MODES FOR EMBODYING THE INVENTION

Figure 1:
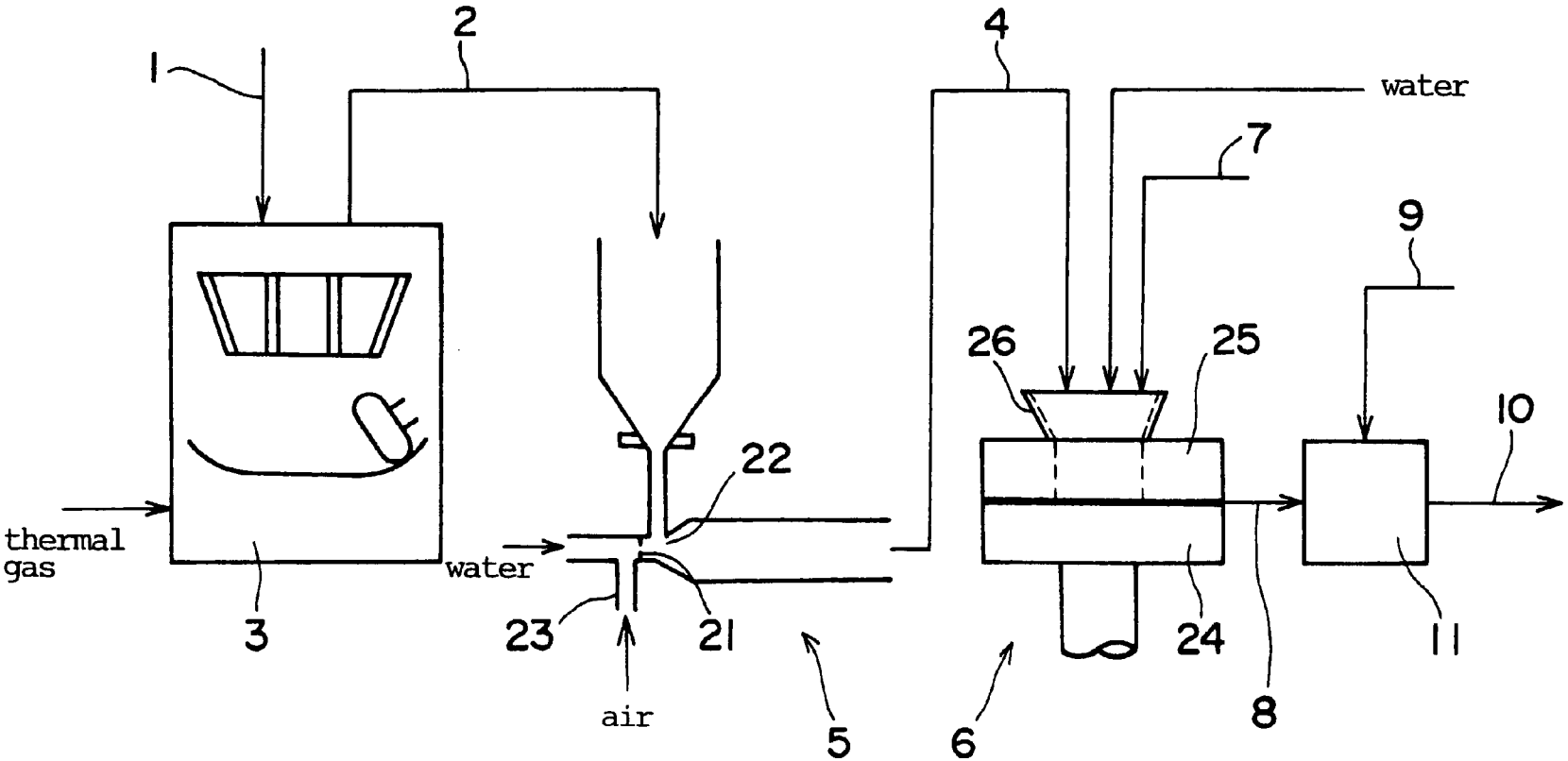
FIG. 1 is a principle view showing an example of a system for producing the CWM according to the present invention.

The structure of the present invention will be explained in detail with reference to the best modes shown in the drawings.

FIG. 1 shows an example where a dry manufacturing system for the high-density coal-water mixed fuel is applied to the CWM. The CWM dry manufacturing system includes: a mill 3 for grinding a coal 1 to obtain pulverized coals 2; an air-water mixed jet pump 5 for providing wet pulverized coals 4 by giving moisture to the pulverized coals 2; a spheroidizing apparatus 6 for mixing the wet pulverized coals 4 and the hydrophilic colloid 7 to generate pulverized coal gel 8; and an agitator 11 for mixing the pulverized coal gel 8 and dispersant 9 to generate CWM 10. That is, according to the present invention, the hydrophilic colloid 7 causing the protective effect with respect to the pulverized coals 2 is added to the high-density coal-water mixed fuel such as CWM obtained by mixing water, the dispersant 9 and the pulverized coals 2 made by grinding the coal 1 so as to provide a predetermined particle size distribution.

Usually, the mill 3 is referred to as the dry vertical mill and generally used for producing the pulverized coals for a coal boiler in, e.g., a coal burning thermal power plant. The pulverized coals 2 can be obtained by pulverization using the mill 3. The air-water mixed jet pump 5 supplies high-pressure water and air into a nozzle 22 through an orifice 21 and sucks the pulverized coals 2 to produce the wet pulverized coals 4 by hard agitation using the powerful jet water.

Figure 4:
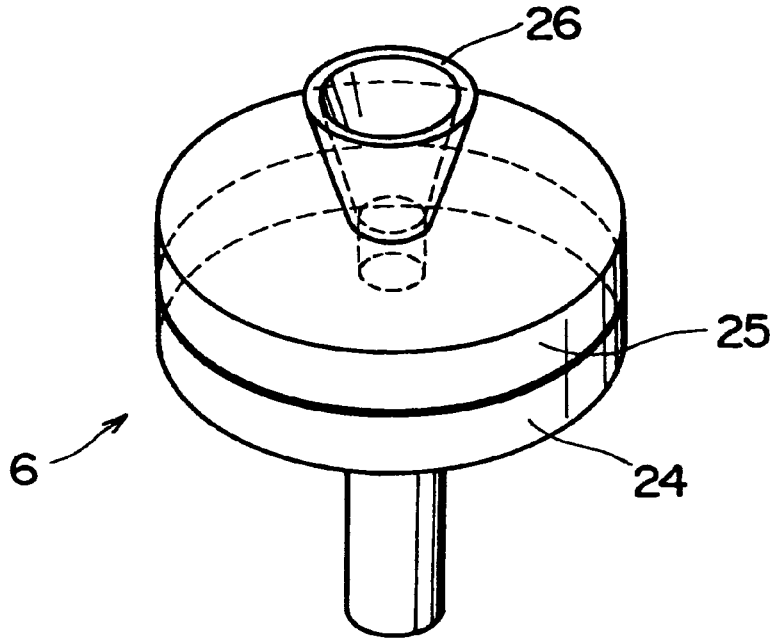
FIG. 4 is a schematic perspective view showing an embodiment of a spheroidizing apparatus.

The wet pulverized coals 4 are continuously and smoothly fed into the spheroidizing apparatus 6 together with the water and the hydrophilic colloid 7. As shown in FIG. 4, the spheroidizing apparatus 6 includes a rotary disk 24 as a first member which has a disc shape and rotates by a drive source such as a motor, a fixed disk 25 as a second member which has a size and a shape substantially equal to those of the rotary disk 24 and does not rotate, and a funnel 26 provided in the center of the fixed disk 25. Respective opposed surfaces of the rotary disk 24 and the fixed disk 25 are parallel with a small gap therebetween. A through hole is formed in the center of the fixed disk 25. A small-diameter portion of the funnel 26 is attached to the opening of the through hole.

Figure 5:
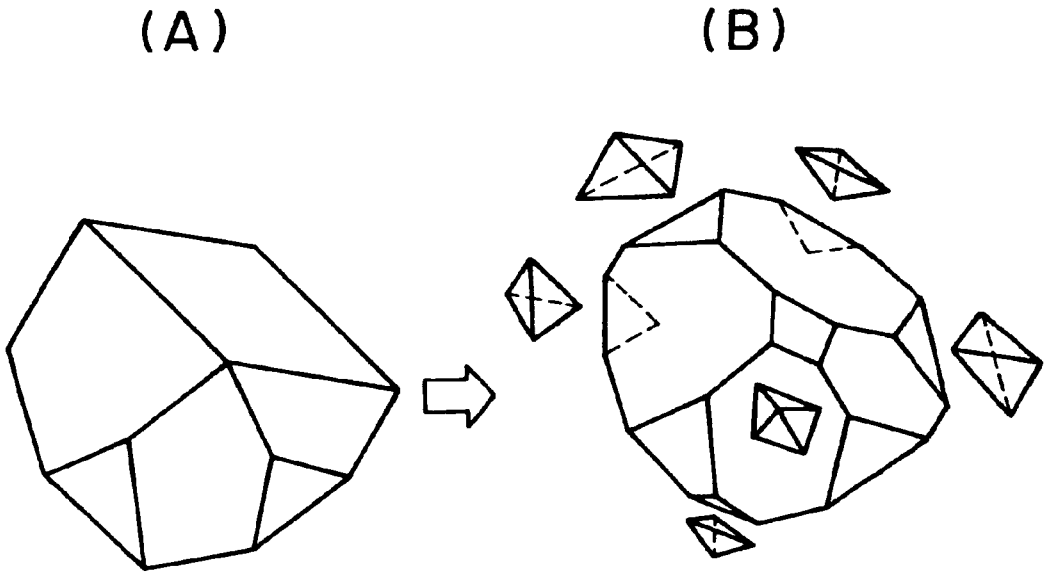
Figure 7:
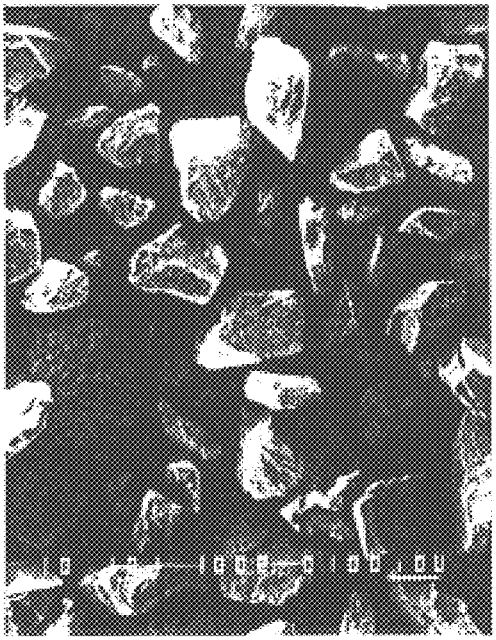
FIG. 7 is a SEM photograph showing the particle structure of the pulverized coal spheroidized by the spheroidizing apparatus.

With the rotary disk 24 being rotated, the wet pulverized coals 4 are poured into the funnel 26 together with the hydrophilic colloid 7 and water. The wet pulverized coals 4 pass through the through hole of the fixed disk 25 and are held between the opposed surfaces of the rotary disk 24 and the fixed disk 25 so that they are pushed and rubbed to be abraded together and moved toward the outer periphery by the centrifugal force. At this time, the particles of the wet pulverized coals 4 come into contact with each other to be rubbed together, and hence angles of the particles are removed and the particles are spheroidized, thereby generating superfine particles, as shown in FIG. 5(B). The superfine particles enter a gap between the larger particles by simultaneously-added water, and the CWM is produced. Here, the CWM has the particles which have been spheroidized by eliminating angles thereof and a sufficient amount of the superfine particles, as shown in FIG. 7. Although the water is added in the spheroidizing apparatus 6 in this embodiment, it does not have to be added.

It is to be noted that the respective opposed surfaces have a flat shape but they may have a shape to which irregularities are formed such as a groove or a protrusion. According to this structure, the wet pulverized coals 4 are complexly pushed and rubbed to assuredly perform spheroidization and generation of the superfine particles.

Also, the hydrophilic colloid 7 and the particles of the wet pulverized coals 4 are mixed in the spheroidizing apparatus 6, which causes the secondary bond of the particles of the pulverized coals 4, aggregation due to attraction between the particles of the pulverized coals 4, or cross linking aggregation of the pulverized coals by the high polymer. The wet pulverized coal 4 is, therefore, gelatinized, and the jellied pulverized coal gel 8 is hence generated.

Figure 13:
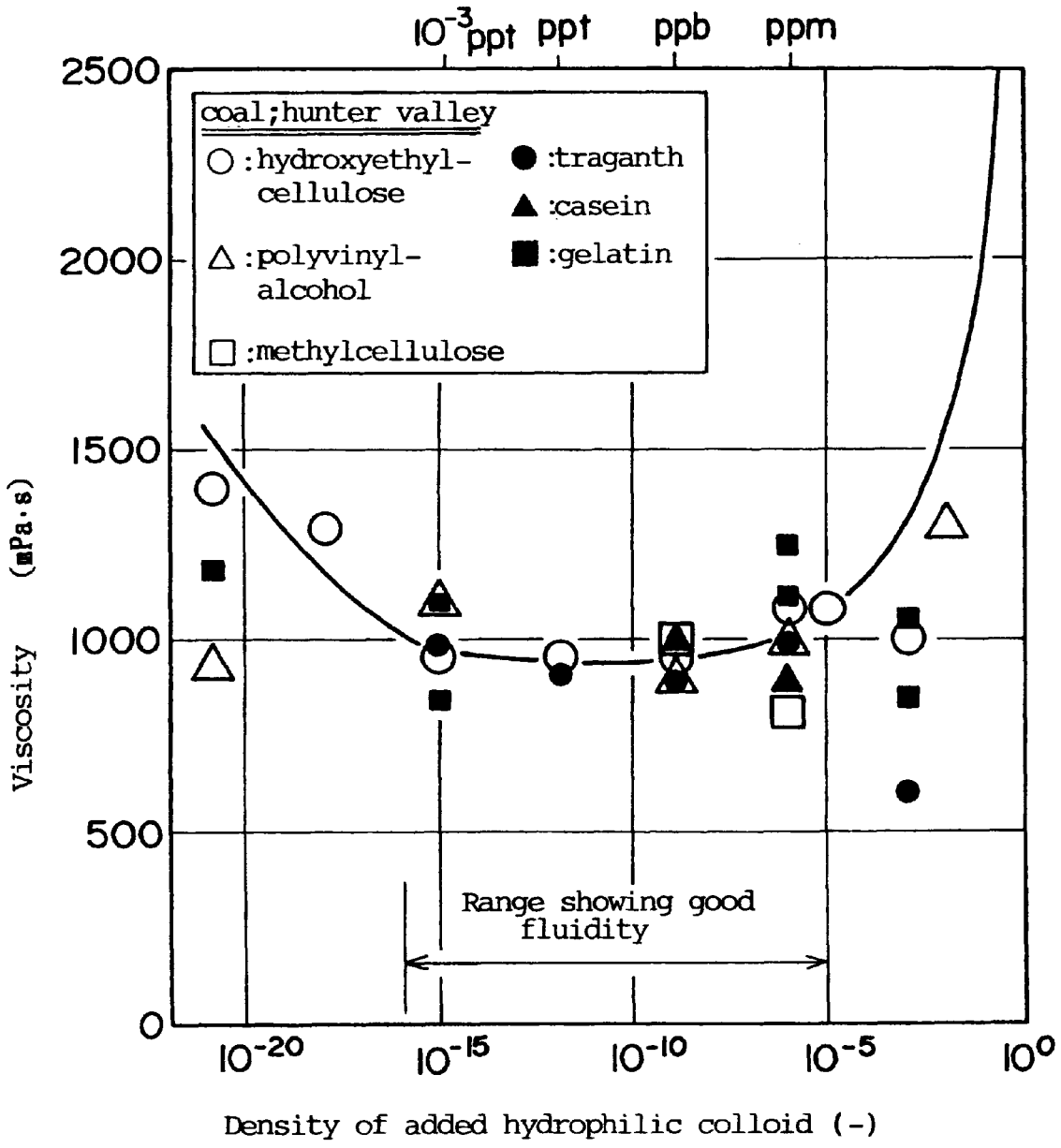
FIG. 13 is a graph showing the relationship between the density of the hydrophilic colloid to be added and the viscosity of the CWM.

Here, there is no problem if an amount of the hydrophilic colloid 7 to be added is enough for causing the gelation effect, but gelation is proceeded and a large amount of the dispersant 9 is needed for solation if the amount of the hydrophilic colloid 7 is too large. If that amount is too large, it is impossible to reduce an amount of the dispersant 9 and attain the cost down of the CWM 10 or the like. For example, as shown in FIG. 13, in the case where an amount of the surface active agent which is the dispersant is reduced to ½ of the conventional amount, i.e., 0.2 wt % in the CWM having the density of 70.6%, the fluidity is deteriorated when the amount of the hydrophilic colloid to be added exceeds 10 ppm of the CWM, and a large amount of the dispersant 9 must be added, which is not different from the conventional amount. Further, a lower limit of the amount of the hydrophilic colloid 7 to be added is larger than that for causing reciprocal aggregation with the pulverized coals. If the amount of the hydrophilic colloid to be added is lower than this lower limit, the sensitizing effect is caused. For example, as shown in FIG. 13, since the fluidity is degraded when the amount of the hydrophilic colloid is less than $10^{-4}$ ppt in the CWM having the density of 70.6%, it is preferable that this amount exceeds the $10^{-3}$ ppt order. In case of obtaining the CWM having the density of, e.g., 70%, the amount of the hydrophilic colloid 7 to be added is preferably less than 1 wt % with respect to the water added to the CWM and larger than an amount for causing the reciprocal aggregation of the pulverized coals, or more preferably it ranges between the ppm order and the ppt order, e.g., 1 ppm through $10^{-3}$ ppt, or most preferably it ranges between the ppt order and the ppb order, e.g., 1 ppt through 1 ppb. In this case, an amount of the surface active agent to be used can be reduced as compared with the conventional amount, and more particularly, the amount of the surface active agent to be used can be reduced to approximately ⅓ of the conventional amount when adding this agent in the range of 1 ppt through 1 ppb. Incidentally, although a preferred amount of the hydrophilic colloid 7 to be added may differ depending on the density of the CWM, an amount of the dispersant to be used can be reduced to at least ½ through ¼ of the conventional amount without being affected by the density of the CWM if the amount of the hydrophilic colloid 7 is set between the above-described ppt order and the ppb order.

Further, in case of using the very inexpensive ion neutralizer whose surface active effect is low as the dispersant 9, solation can be inexpensively achieved with a large amount of the ion neutralizer even if approximately 1 wt % of the hydrophilic colloid 7 is added. However, when using the expensive surface active agent which has been conventionally used and has the high surface active effect as the dispersant 9, an amount of the hydrophilic colloid 7 is determined to be not more than 100 ppm. This can extremely reduce an amount of the surface active agent to ½ to ¼ of the conventional amount, and the amount of the hydrophilic colloid 7 itself can be also decreased because it is equal to or less than 100 ppm.

Materials exemplified in Table 1 can be used as the hydrophilic colloid 7. Typically, it is preferable to use gelatin, gum arabic, casein, glue, traganth, albumin, dextrin, starch, hydroxyethylcellulose, polyvinyl alcohol, methylcellulose and others. However, present invention is not limited to these materials, and any other kind of hydrophilic colloid 7 can be similarly used if it can demonstrate the protective effect with respect to the wet pulverized coal 4 which is the hydrophobic colloid particle. In addition, a number of type of the hydrophilic colloid 7 to be added is not restricted to one, and a plurality of kinds of the hydrophilic colloid 7 may be simultaneously or separately added.

TABLE 1

| NATURAL HIGH POLYMER | SEMISYNTHETIC PRODUCT | SYNTHETIC PRODUCT |
|---|---|---|
| STARCHINESS | CELLULOSE GROUP | POLYVINYL |
| SWEET POTATO | VISCOSE | ALCOHOL(POVAL) |
| STARCH | METHYL- | POLYACRYLIC |
| POTATO STARCH | CELLULOSE (MC) | NATRIUM |
| TAPIOCA STARCH | ETHYLCELLULOSE | POLYETHYLEN |
| WHEAT STARCH | (EC) | OXIDE |
| CORN STARCH | HYDROXYETHYL- | |
| MANNAN | CELLULOSE (HEC) | |
| KONJAK | CARBOXYMETHYL- | |
| SEA WEEDS | CELLULOSE (CMC) | |
| FUNORI | STARCH GROUP | |
| AGAR (GALACTAN) | SOLUBLE STARCH | |
| SODIUM ALGINATE | CARBOXYMETHYL | |
| PLANT MUCILAGE | STARCH (CMS) | |
| NIBICUS MANIHOT | DIALDEHYDE | |
| TRAGACANTH | STARCH | |
| GUM | | |
| GUM ARABIC | | |
| MICROBIOLOGICAL | | |
| MUCILAGE | | |
| DEXTRIN | | |
| LEVAN | | |
| PROTEIN | | |
| GLUE | | |
| GELATIN | | |
| CASEIN | | |
| COLLAGEN | | |

The pulverized coal gel 8 is continuously and smoothly supplied into the agitator 11. The dispersant 9 is put into the agitator 11 where the dispersant 9 is sufficiently agitated and mixed with the pulverized coal gel 8. When the secondary bond between the particles of the pulverized coal gel 8 is destroyed, when the ion antagonism is observed in the pulverized coal particles, or when the dispersant 9 itself or the knitting-ball-like high polymer fills the unoccupied area of the surface of the pulverized coal particles, the pulverized coals are also solated. The pulverized coal particles are then stabled in the sol state without being aggregated. This can provide the CWM 10 having the fluidity suitable for being transported through the pipeline.

Although the surface active agent is generally used as the dispersant 9, the present invention is not restricted to this substance and any other dispersion stabilizing material can be used only if that material (solating agent) can demonstrate the so-called solation effect, by which the pulverized coal particle that has been temporarily turned to the reversible gel is again solated, like a chelating agent for fetching the polyvalent ion which is eluted from the pulverized coal particle and mainly consists of the metal ion, an ion neutralizer which neutralizes the aforesaid polyvalent ion to prevent the ion bonding with the protective colloid, and others. As a chelating agent, it is possible to use, e.g., ethylenediaminetetraacetic acid (EDTA) or the like. Further, a shielding agent for avoiding the ion bond between the pulverized coal particles may be used as the dispersant 9.

According to the CWM producing system having the above-mentioned structure, the pulverized coals 2 are first obtained by pulverization using the mill 3. Moisture is then given to the pulverized coals 2 by the air-water mixed jet pump 5 to produce the wet pulverized coals 4 in a short period. The hydrophilic colloid 7 and water are given to the thus-obtained wet pulverized coal 4 and they are ground together in the spheroidizing apparatus 6 in order to achieve the secondary bond and aggregation of the pulverized coal particles and perform spheroidization of the same, thereby obtaining the pulverized coal gel 8. The dispersant 9 is added and mixed to the pulverized coal gel 8 in the agitator 11, and the secondary bond and the aggregation of the pulverized coal particles are destroyed to obtain the CWM 10. It is to be noted that the density of the CWM 10 can be adjusted by controlling an amount of water to be added by the air-water mixed jet pump 5 or the spheroidizing apparatus 6.

According to this embodiment, since the wet pulverized coals 4 are mixed with the dispersant 9 after adding the hydrophilic colloid 7 to the wet pulverized coals 4, an amount of the dispersant 9 to be mixed can be greatly reduced as compared with that obtained when no hydrophilic colloid 7 is added. Specifically, as shown by the plot of the CWM having the density of 70.6 wt % (indicated by white circles and black circles) in FIG. 14, addition of approximately 1 ppm of the hydrophilic colloid 7 provides the viscosity equivalent to that obtained when solely adding about 0.4% of the dispersant 9 without using hydrophilic colloid 7 in the above-mentioned producing method, and an amount of the dispersant 9 to be added in the same method can be reduced to ½ to ¼ of the conventional amount. The cost for the CWM 10 can be, therefore, lowered by reducing the amount of the dispersant 9 to attain the cost down.

Further, according to the present embodiment, since the pulverized coal particle is spheroidized by the spheroidizing apparatus 6, water can easily enter between the pulverized coal particles. This ensures the hydrophilic colloid 7 or the dispersant 9 to be efficiently dispersed around the pulverized coal particle, and the gelation and solation effects of the pulverized coal due to formation of the protective colloid and the secondary bond/aggregation proceed, thereby further reducing the amount of the hydrophilic colloid 7 and dispersant 9 to be added. Besides, the superfine particles are attached on the surface of the pulverized coals in the covering manner by spheroidization of the pulverized coals to cause the lubrication effect, which can improve the fluidity of the CWM. Specifically, as shown by white triangles and black triangles in FIG. 15, the fluidity of the spheroidized CWM (shown by the black triangles) is higher than that of the non-spheroidized CWM (shown by the white triangles).

Furthermore, according to this embodiment, since the CWM is produced by the dry producing method, the production time can be reduced to ½ to ⅕ of that of the wet producing method, and the drive power can be also decreased to approximately ⅓ of that of the wet producing method. Also, as shown by the black triangles and white squares, spheroidization can provide the CWM according to the dry producing method with the fluidity equivalent to that of the CWM according to the wet producing method.

According to this embodiment, water is added to the pulverized coals 2 to obtain the wet pulverized coals 4, and water is further added to the thus-obtained coals 4 in the spheroidizing apparatus 6 to provide the CWM. Water may be added only once or twice if the CWM having a predetermined density can be ultimately obtained. In addition, the pulverized coals 2 obtained by the mill 3 may be poured into the spheroidizing apparatus 6 together with water. In this case, the air-water mixed jet pump 5 is no longer necessary, thereby minimizing the equipment.

Although the above has described one preferred embodiment according to the present invention, the invention is not restricted to this, and various modifications are possible within the true scope of the invention.

For example, description has been mainly given as to the case where the invention is applied to the dry CWM production in this embodiment, and a technique for improving the fluidity of the high-density coal-water mixed fuel by addition of the hydrophilic colloid can be also applied to the wet producing method. Additionally, improvement in the fluidity of the slurry of the pulverized coals by spheroidizing the pulverized coals can be applied to the COM.

Moreover, although the disk to which the funnel 26 of the spheroidizing apparatus 6 is attached is the fixed disk 25, this may be substituted by the rotary disk and the other one may be used as the fixed disk. It is also possible to employ the structure for respectively rotating the both disks. Since rotating the both disks in the opposed directions can further increase the relative velocity between the disks as compared with that when rotating only one disk, which leads to the assured spheroidization. Also, the structure may be such that the rotary disk can be eccentrically rotated or slide without being rotated.

Figure 8:
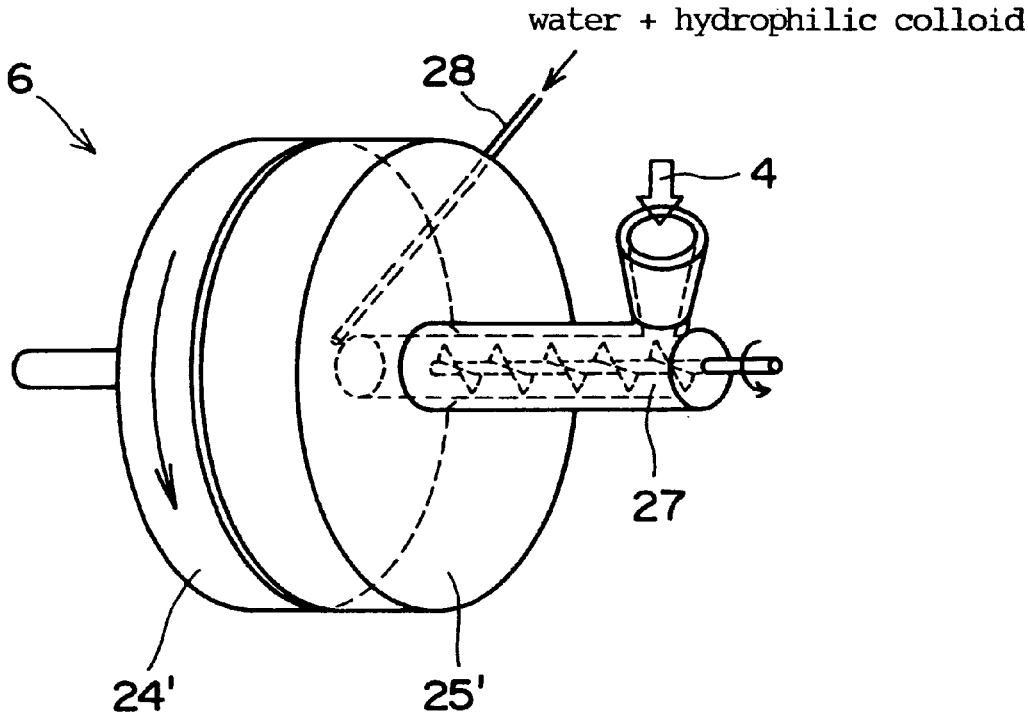
FIG. 8 is a schematic perspective view showing a modification of the embodiment of the spheroidizing apparatus.

As shown in FIG. 8, the spheroidizing apparatus 6 may be installed such that the opposed surfaces of the rotary disk 24' and the fixed disk 25' are substantially perpendicular to a horizontal plane and a screw feeder 27 is fixed to the through hole of the fixed disk 25'. Rotating a screw of the screw feeder 27 supplies the wet pulverized coals 4 between the rotary disk 24' and the fixed disk 25'. Further, a feed water pipe 28 is provided between the rotary disk 24' and the fixed disk 25'. A feed water opening of the feed water pipe 28 is positioned in the center of the opposed surfaces. This structure enables water to be supplied and mixed to the wet pulverized coals 4 between the rotary disk 24' and the fixed disk 25'.

Figure 9:
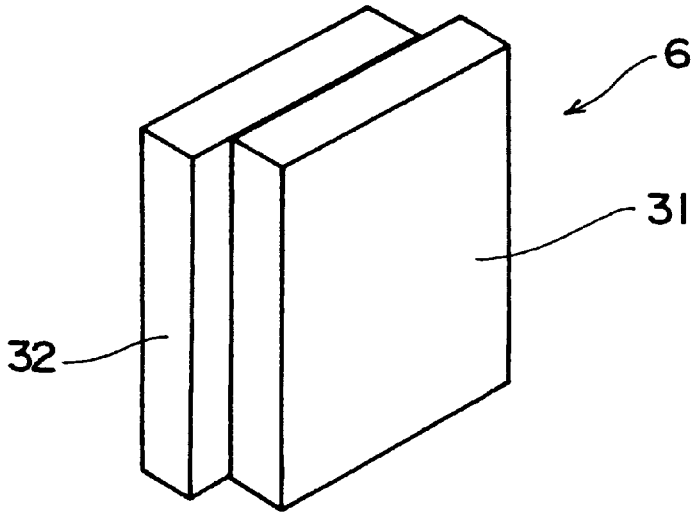
FIG. 9 is a schematic perspective view showing another embodiment of the spheroidizing apparatus.

As shown in FIG. 9, the spheroidizing apparatus 6 may have two flat plates 31 and 32 as the first and second members being opposed to each other with a small gap therebetween. In such a structure, one flat plate 31 is fixed and the other flat plate 32 slides in a direction parallel to the opposed surfaces, or the respective flat plates 31 and 32 move in a direction along which they slide. The wet pulverized coals 4 are supplied from the upper part of the spheroidizing apparatus 6 and held between the respective flat plates 31 and 32. Subsequently, the flat plates 31 and 32 relatively slide to perform spheroidization and generate the superfine particles.

Figure 10:
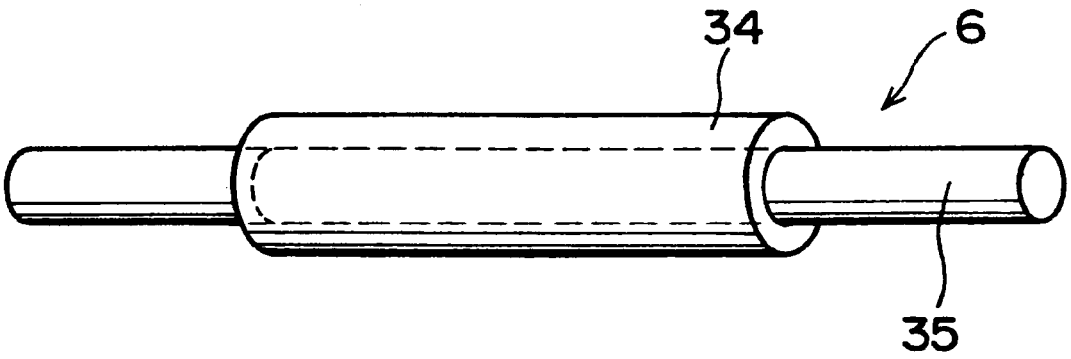
FIG. 10 is a schematic perspective view showing still another embodiment of the spheroidizing apparatus.

Moreover, as shown in FIG. 10, the spheroidizing apparatus 6 may be provided with a cylindrical member 34 as the first member and shaft 35 as the second member which is inserted into the cylindrical member 34 with clearance fit. In this structure, either or both of the cylindrical member 34 and the shaft 35 are relatively moved so as to rotate or slide in the axial direction. By relatively moving the wet pulverized coal 4 held between the cylindrical member 34 and the shaft 35, spheroidization and generation of the superfine particles can be achieved. It is to be noted that concave or convex portions can be formed on the inner peripheral surface of the cylindrical member 34 and the outer peripheral surface of the shaft 35 along the axial direction or the circumferential direction or that helical concave or convex portions can be formed. In addition, in case of flowing the wet pulverized coal 4 inside the cylindrical member 34, this can be facilitated by forcibly flowing the wet pulverized coals 4 from one gap or making the diameters of the cylindrical member 34 and the shaft 35 on one side larger than those of on the other side to form a tapered shape.

Figure 11:
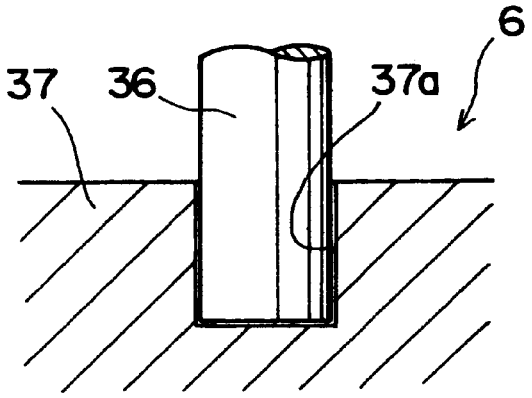
FIG. 11 is a schematic perspective view showing a further embodiment of the spheroidizing apparatus.

Further, as shown in FIG. 11, the structure may be provided with the cylindrical member 36 as the first member and the member 37 as the second member having a concave portion 37*a* in which the outer peripheral surface of the cylindrical member 36 is accommodated with a small gap. In this structure, either or both of the cylindrical member 36 and the member 37 having the concave portion 37*a* relatively are moved so as to rotate or slide in the axial direction. By relatively moving the wet pulverized coals 4 held between the concave portion 37*a* and the cylindrical member 36, spheroidization and generation of the superfine particles are carried out.

Although the respective opposed surfaces are smooth in the structures shown in FIGS. 9, 10 and 11, they may have irregularities such as grooves or projections formed thereon. A plurality of projections that sporadically exist on a straight line at predetermined intervals may be arranged in parallel. With such a configuration, the particles of the wet pulverized coals 4 can be complexly rubbed together, thereby further assuredly performing spheroidization and generation of the superfine particles.

In this embodiment, although an interval between the opposed surfaces is fixed, this interval may be changeable. In this case, the wet pulverized coals 4 can be pressured when slightly minimizing the interval.

Figure 2:
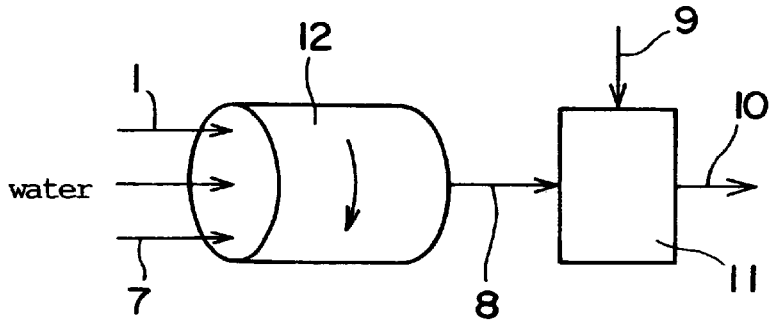
FIG. 2 is a principle view showing an example of another system for producing the CWM according to the present invention.

Although the CWM is produced according to the dry producing method in this embodiment, in case of, e.g., the wet grinding method, the coal 1, water and the hydrophilic colloid 7 are added in the rotary wet grinder 12 to be pulverized for producing the pulverized coal gel 8, as shown in FIG. 2. The dispersant 9 is added to the pulverized coal gel 8 and mixed by agitator 11. Since the hydrophilic colloid 7 is added to the pulverized coals to produce the pulverized coal gel 8 and the pulverized coal gel 8 is solated by using the dispersant 9 to obtain the CWM 10 in this producing method too, an amount of the dispersant 9 to be added can be reduced.

Figure 3:
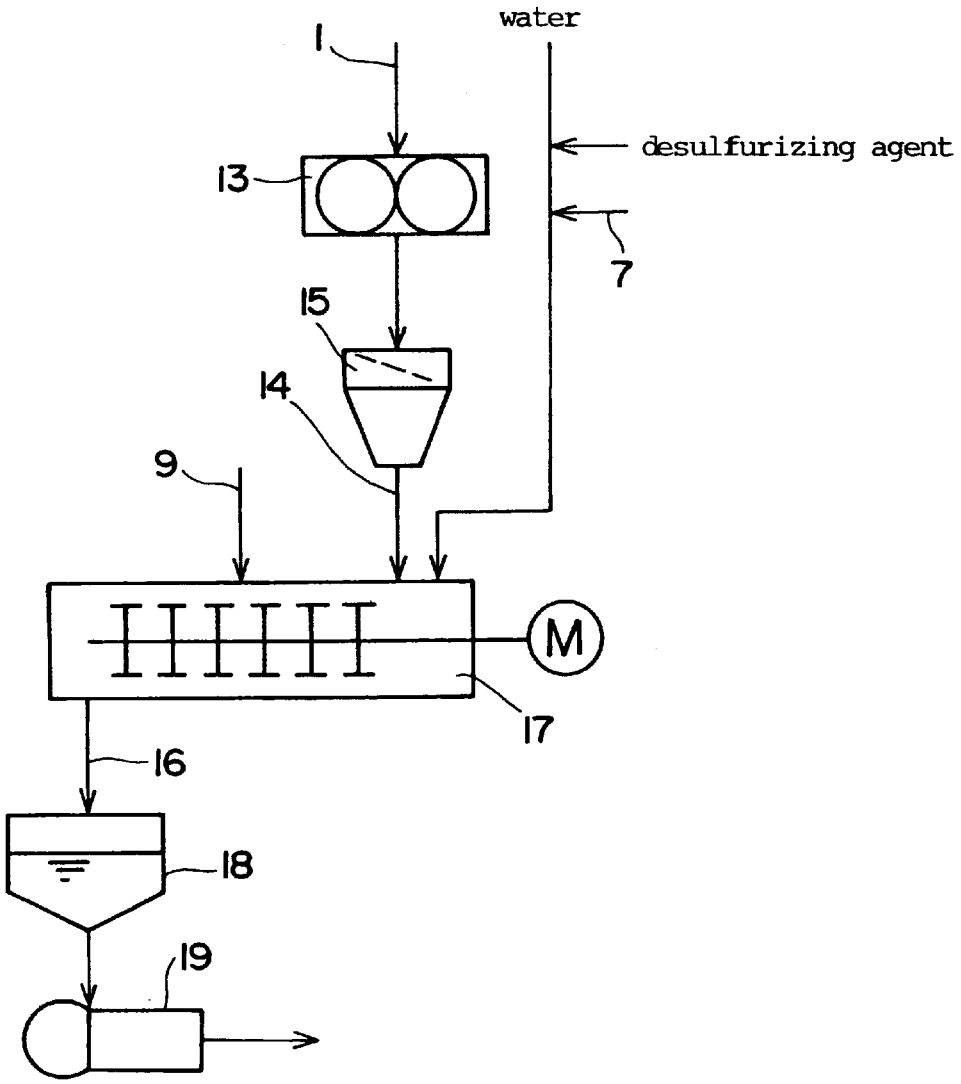
FIG. 3 is a principle view showing an example of a system for producing the CWP according to the present invention.

Although the CWM is produced in each of the above-mentioned embodiments, the present invention is not restricted to them, and the CWP can be similarly produced. As shown in FIG. 3, the production system in this case is provided with a coarse crusher 13 for grinding the coal 1, a screen 15 for selecting the pulverized coals 14 whose particle size is equal to or less than a predetermined value, a kneading machine 17 for kneading the pulverized coals 14, water, the desulfurizing agent, and the hydrophilic colloid 7 to produce the CWP 16, a tank 18 for storing the CWP 16, and a CWP pump 19 for discharging the CWP 16. In this production system, the dispersant 9 is added during kneading in the kneading machine 17. In other words, the pulverized coals 14, water, the desulfurizing agent and the hydrophilic colloid 7 are put in the kneading machine 17 to be kneaded, and the pulverized coal gel is generated in the upstream part of the kneading machine 17. The pulverized coal gel is mixed with the dispersant 9 for solation, thereby producing the CWP 16. Since the hydrophilic colloid 7 is added to the pulverized coals 14 to manufacture the pulverized coal gel and the pulverized coal gel is solated by using the dispersant 9 to obtain the CWP in this production system too, an amount of the dispersant 9 to be added can be reduced. Moreover, the technique for spheroidizing the pulverized coals can be also applied to manufacture of the COM.

(Embodiment 1)

There has been performed an experiment for confirming generation of the superfine particles by removing angles of the pulverized coals for spheroidization and the particle size distribution by using the mill 3, the air-water mixed jet pump 5, and the spheroidizing apparatus 6 shown in FIG. 1.

Figure 6:
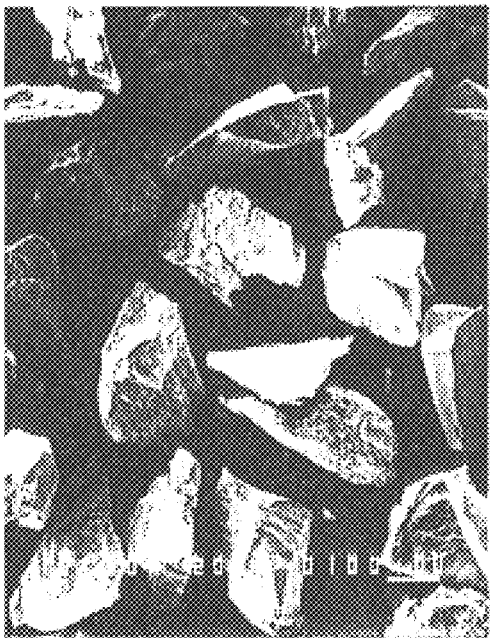
FIG. 6 is a SEM photograph showing the particle structure of the pulverized coal before spheroidization.
Figure 12:
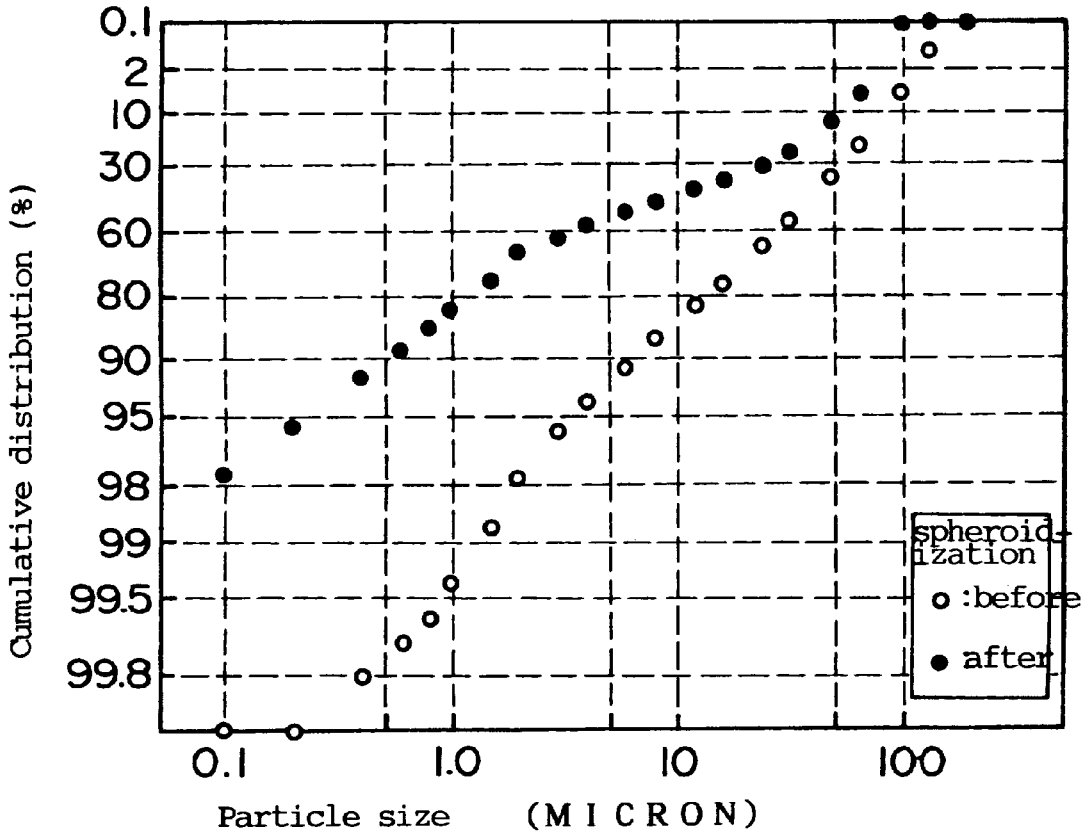
FIG. 12 is a particle size distribution view (mass basis) of the wet pulverized coal and the CWM in the producing method according to the present invention.

The pulverized coals 2 were obtained by the dry vertical mill 3. Water was then mixed to the pulverized coals 2 by the air-water mixed jet pump 5 to obtain the wet pulverized coals 4. The SEM (scanning electron microscope) photograph in FIG. 6 shows the form of the thus-obtained wet pulverized coal 4. As shown in the figure, the particle was substantially an angular polyhedron having an undefined shape and relatively large. Further, its particle size distribution is as shown by the white circles in FIG. 12.

The hydrophilic colloid was added to the wet pulverized coals 4 and the coals 4 were rubbed together in the spheroidizing apparatus 6 to provide the pulverized coal gel, and the dispersant was further added thereto, thereby obtaining the CWM. The SEM photograph in FIG. 7 shows the form of the CWM particle. As shown in the figure, angles of the pulverized coals 2 were scraped off and the pulverized coals 2 were spheroidized to reduce the surface area thereof. Further, the particle size distribution (mass basis) is as shown by black circles in FIG. 12. That is, as apparent from the drawing, the particle size not more than 100 $\mu$m accounts for approximately 100%; that not more than 10 $\mu$m, approximately 45%; and that not more than 1 $\mu$m, approximately 17%, thus satisfying the particle size distribution required for the CWM.

(Embodiment 2)

The mill 3, the air-water mixed jet pump 5, and the spheroidizing apparatus 6 shown in FIG. 1 were used to carry out the CWM producing experiment utilizing the protective colloid.

In order to verify the effect of the protective colloid, the regular pulverized coal mixed with approximately 30% of water having a small amount of the hydrophilic colloid added thereto was compared with that using no hydrophilic colloid for confirming the wettability of the pulverized coals. According to this experiment, in case of the pulverized coals having no hydrophilic colloid, the pulverized coals first repelled water and they were unable to be well-mixed with water even though kneading was performed. However, in case of the pulverized coal having the hydrophilic colloid added thereto, the repellent force was weak from the beginning, and the pulverized coals and water were relatively easily kneaded. In this manner, the experiment for producing the CWM by utilizing the protective colloid was carried out after confirming that use of the hydrophilic colloid contributed to improvement in the wettability of the pulverized coal.

As shown in FIG. 13, when producing the CWM having the density of 70%, hydroxyethylcellulose (HEC), polyvinyl alcohol, methylcellulose, traganth, casein and gelatin were used as the hydrophilic colloid 7 and added to water to be supplied in the spheroidizing apparatus 6. An amount of the hydrophilic colloid 7 to be added was reduced from the % order to the ppm and ppt orders with respect to water in order to confirm the effect of the protective colloid and find an appropriate amount. A specific amount of the hydrophilic colloid 7 was determined as 1 wt %, 10 ppm, 1 ppm, 1 ppb, 1 ppt, $10^{-3}$ ppt, $10^{-6}$ ppt and $10^{-9}$ ppt with respect to water. The Hunter Valley coal (from Australia) was used and the surface active agent was used as the dispersant 9. The amount of the dispersant to be added was 0.2 wt % relative to the CWM, and the density of the CWM was 70 wt %. The viscosity of the produced CWM was measured at a temperature of 25° C., and the relationship between the viscosity and the density of the added hydrophilic colloid was examined. A rotational viscometer Rheomat 115 (manufactured by Contraves AG in Switzerland) was used as a viscometer, and a number of revolutions was increased by a program and then decreased after being kept constant for automatic measurement. The result is as shown in FIG. 13. The similar result was obtained when any other kind of coal was used.

As shown in the drawing, the fluidity was good when the amount of the hydrophilic colloid to be added ranged from $10^{-4}$ ppt to 10 ppm with respect to water, and especially the fluidity was the best when it ranged from 1 ppt to 1 ppb. Further, when the fluidity was less than $10^{-4}$ ppt or exceeds 10 ppm, the fluidity was deteriorated and the result of measurement of the viscosity became unstable. Although the rate of the hydrophilic colloid to be added is represented with respect to the water of the CWM, the effect for adding the hydrophilic colloid does not change even if the same rate of the hydrophilic colloid is added to the entire CWM because it is demonstrated in the ppm order and the ppt order.

(Embodiment 3)

There were experimented changes brought to the viscosity by the amount of the dispersant to be added when producing the CWM by using the mill 3, the air-water mixed jet pump 5 and the spheroidizing apparatus 6 shown in FIG. 1 at each density of the CWM in respective cases where the hydrophilic colloid 7 was added and where no hydrophilic colloid 7 was added.

Figure 14:
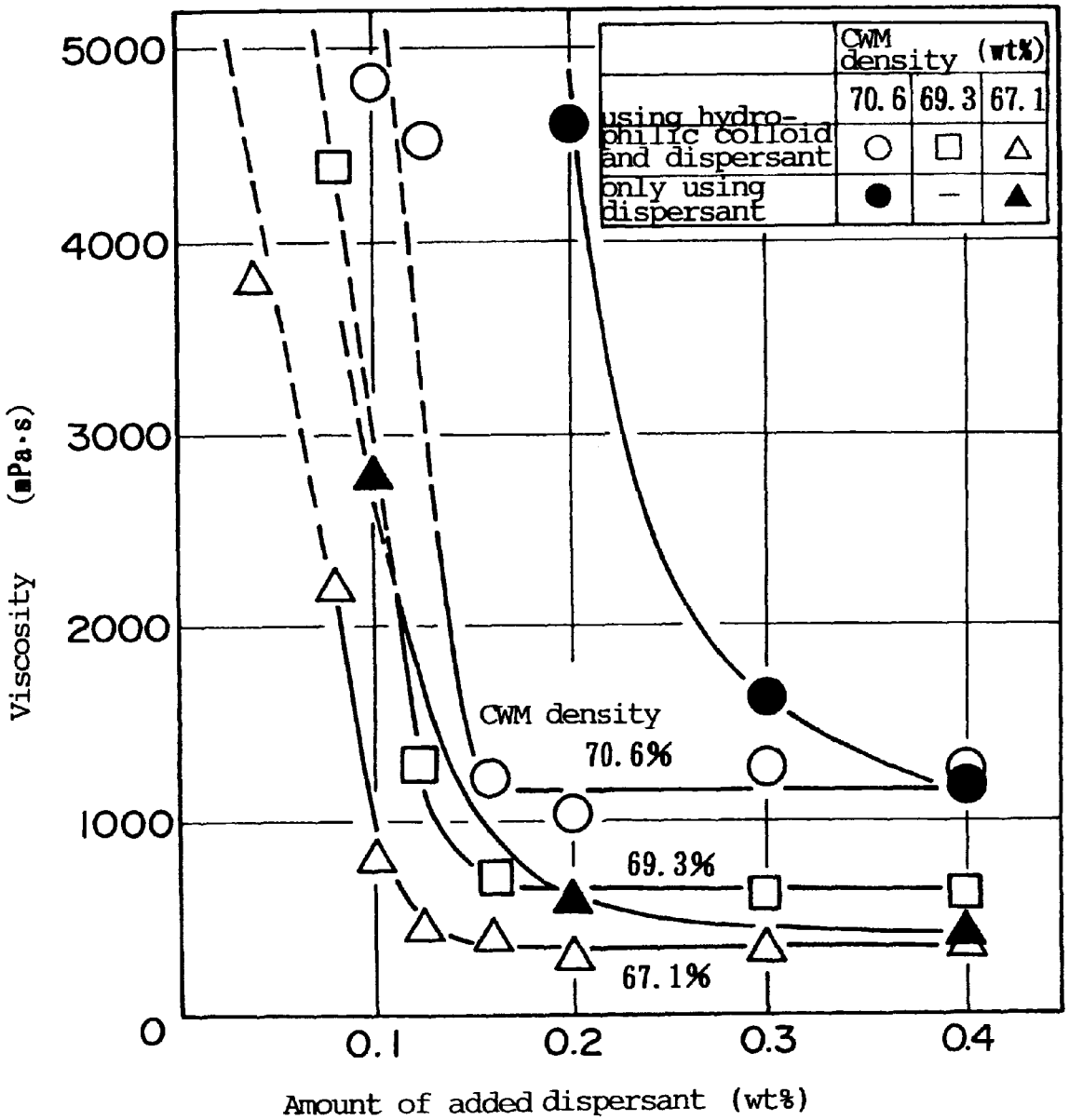
FIG. 14 is a graph showing the relationship between an amount of the dispersant to be added and the viscosity of the CWM.

In the experiment, the Hunter Valley coal (from Australia) was used and 1 ppm of HEC was added as the hydrophilic colloid 7 to measure the viscosity at a temperature of 25° C. The relationship between the viscosity and the amount of dispersant 9 to be added was then examined as to the produced CWM. FIG. 14 shows the result. In case of the CWM having the density of 69.3 wt %, since the experiment was performed as to the case where the hydrophilic colloid 7 was added, the result of this is shown in the drawing for the reference. Further, a unit of the amount of the dispersant 9 added is wt % relative to the CWM.

As apparent from the drawing, the viscosity of 1200 mPa.s is observed when the hydrophilic colloid 7 demonstrating the protective effect to the pulverized coals is not used in the CWM having the density of 70.6% with the current amount of the dispersant added being 0.4%, and values of the viscosity became 1600 mPa.s and about 4500 mPa.s when the amount of the dispersant added is reduced to 0.3% and 0.2%, respectively. On the other hand, when the protective colloid was used, the viscosity is 1200 mPa.s and is a substantially fixed value even if the amount of the surface active agent added is reduced from 0.4% to 0.3%, 0.2% and 0.16%. Further, in regard of the CWM having the density of 67.1%, values of the viscosity become 450 mPa.s, 600 mPa.s and about 2800 mPa.s with the amounts of the surface active agent added being 0.4%, 0.2% and 0.1%, respectively, when no hydrophilic colloid is added. On the contrary, when the hydrophilic colloid is added, the viscosity becomes 400 mPa.s and is a substantially fixed value even if the amount of the surface active agent added is reduced to 0.13%, and the added amount for achieving 900 mPa.s (±300 mPa.s) which is a reference value of the CWM viscosity is lower than 0.1%.

In this manner, the surface active agent can be reduced by using the hydrophilic colloid for causing the protective effect to the pulverized coals. The reduction ratio is approximately 1/2.5 for obtaining the viscosity when using no hydrophilic colloid, and the reduction radio can be also ⅓ or lower provided that it is enough to satisfy a reference viscosity value in the case of the CWM having the density equal to or less than 70.0%.

(Embodiment 4)

There was examined the influence of spheroidization of the pulverized coals over the fluidity/viscosity when producing the CWM by using the pulverized coals obtained by the mill 3 shown in FIG. 1 in respective cases where only the spheroidizing apparatus 6 was used, where only the air-water mixed jet pump 5 shown in FIG. 1 was used and where the wet producing method was employed.

Figure 15:
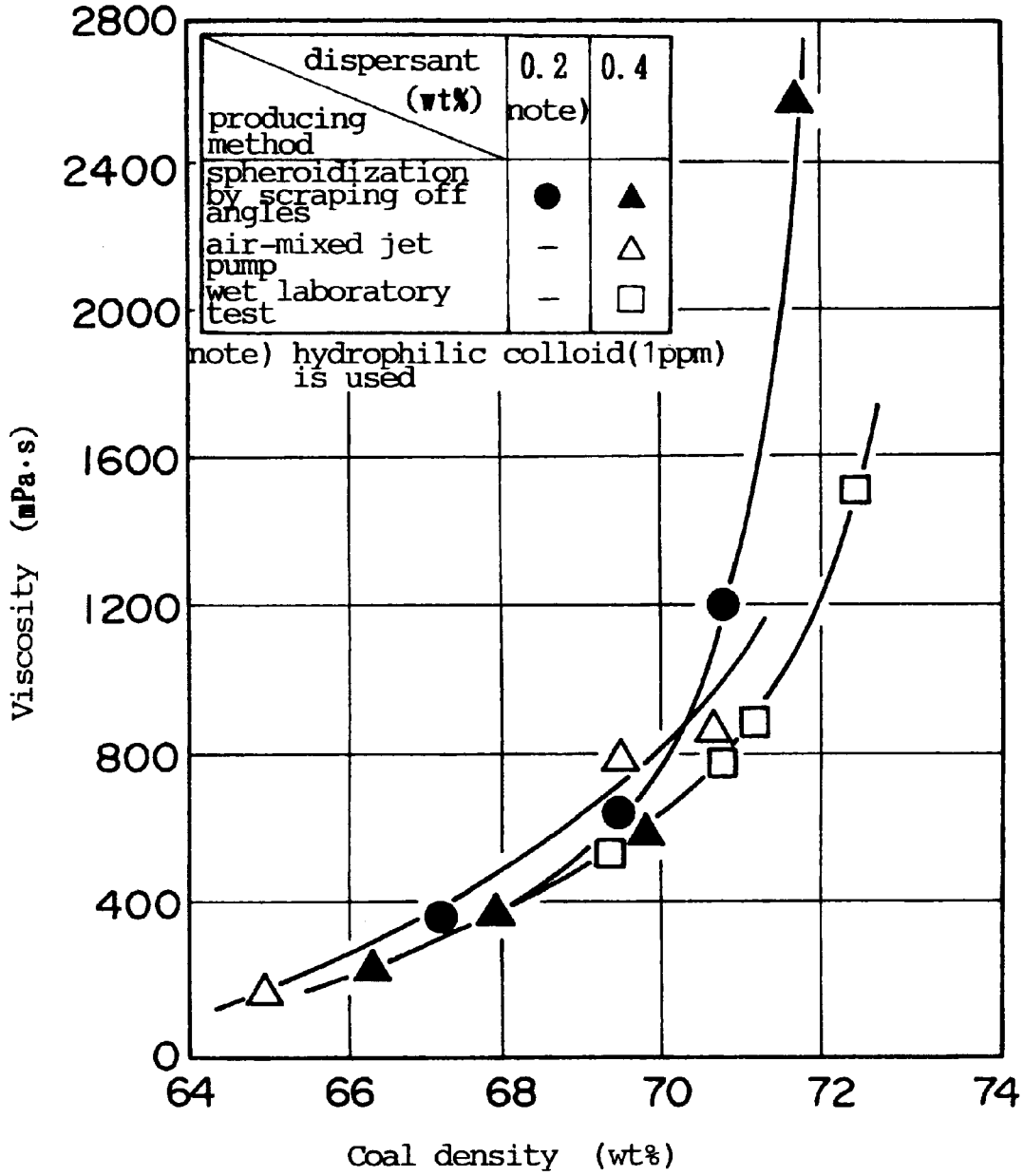
FIG. 15 is a graph showing the relationship between the coal density and the viscosity of the CWM.

In this experiment, the Hunter Valley coal (from Australia) was used, and the polystyrene-sulfonic-aid-soda-contained surface active agent which is 0.4 wt % of the CWM was added as the dispersant 9 and the same which is 0.2 wt % of the CWM was added to produce the CWM after spheroidization by using the spheroidizing apparatus 6. When the amount of the dispersant 9 added was 0.2 wt %, 1 ppm of the hydrophilic colloid 7 was added in advance. Further, the amount of the dispersant 9 added was the current value, i.e., 0.4 wt % to produce the CWM when only the air-water mixed jet pump 5 without the spheroidizing apparatus 6 and when employing the wet producing method. Here, the Warkworth coal (from Australia) was used. The viscosity of the thus-produced CWM was measured to examine the relationship between the viscosity and the coal density. The result is as shown in FIG. 15. It is to be noted that the a temperature at which measurement was carried out was 25° C.

As shown in the drawing, when only the spheroidizing apparatus 6 was used, addition of 1 ppm of the hydrophilic colloid 7 provided the fluidity, which is equivalent to that of the CWM (shown by the black triangles) having the current amount of the dispersant mixed therein, even in the case of the CWM (shown by the black circles) having the dispersant 9 whose amount is reduced to ½ of the current amount. Further, in comparison between the CWMs in which the dispersant has the current amount, the fluidity of the CWM (shown by the black triangles) spheroidized by the spheroidizing apparatus 6 was higher than that of the non-spheroidized CWM (shown by the white triangles) obtained by using only the air-water mixed jet pump 5. Also, the fluidity of the CWM (shown by the black triangles) obtained by using only the spheroidizing apparatus 6 became equivalent to that of the CWM (shown by the white squares) produced according to the wet producing method. The result of this experiment proves that the CWM having the good fluidity can be produced by spheroidizing the pulverized coals.

What is claimed is:

1. A high-density coal-water mixed fuel comprising pulverized coals produced by grinding a coal so as to provide a predetermined particle size distribution, water, dispersant, and hydrophilic colloid which caused a protective effect with respect to the pulverized coals and is present in an amount of $10^{-4}$ ppt to $10^{6}$ ppt of the water.

2. A high-density coal-water mixed fuel according to claim 1, wherein an amount of the hydrophilic colloid is 1 ppt to $10^{3}$ ppt of the water.

3. A method for producing a high-density coal-water mixed fuel comprising mixing pulverized coals produced by grinding a coal to a predetermined particle size distribution, with water to form a mixture; adding to the mixture hydrophilic colloid which causes a protective effect with respect to the pulverized coals and whose amount is $10^{-4}$ ppt to $10^{6}$ ppt of the water to form a gel; and then adding a dispersant to the gel to form a sol.

4. A method for producing the high-density coal-water mixed fuel according to claim 3, wherein the pulverized coals obtained by dry milling are further abraded so as to be pushed and rubbed together so that the pulverized coals are spheroidized by scraping off their angles and superfine particles are generated.

5. A method for producing the high-density coal-water mixed fuel according to claim 3, wherein an amount of the hydrophilic colloid is 1 ppt to $10^{3}$ ppt of the water.

6. A method for producing the high-density coal-water mixed fuel according to claim 4, wherein an amount of the hydrophilic colloid is 1 ppt to $10^{3}$ ppt of the water.

7. A method for producing a high-density coal-water mixed fuel comprising the steps of: obtaining pulverized coals having a particle size substantially equal to or less than a predetermined value by dry-milling a coal by a mill; using a spheroidizing apparatus for pushing and rubbing the pulverized coals to rub the pulverized coals together in order to spheroidize the pulverized coals by scraping off their angles and generate superfine particles; adding water to the pulverized coals after using the spheroidizing apparatus, to form a mixture, and adding to the mixture hydrophilic colloid which causes a protective effect with respect to the pulverized coals in the amount of $10^{-4}$ ppt to $10^{6}$ ppt of the water.

* * * * *